US007695268B2

(12) United States Patent
Klettenberg

(10) Patent No.: US 7,695,268 B2
(45) Date of Patent: Apr. 13, 2010

(54) SYSTEM AND METHOD FOR MANUFACTURING CONCRETE BLOCKS

(75) Inventor: Charles N. Klettenberg, Maple Grove, MN (US)

(73) Assignee: Marshall Concrete, Minneapolis, MN (US)

( * ) Notice: Subject to any disclaimer, the term of this patent is extended or adjusted under 35 U.S.C. 154(b) by 220 days.

(21) Appl. No.: 11/788,134

(22) Filed: Apr. 19, 2007

(65) Prior Publication Data

US 2008/0258340 A1 Oct. 23, 2008

(51) Int. Cl.
*B28B 7/10* (2006.01)

(52) U.S. Cl. ..... 425/353; 425/413; 425/422; 425/441

(58) Field of Classification Search ..... 425/253–255, 425/338, 357–358, 413, 416, 422, 441
See application file for complete search history.

(56) References Cited

U.S. PATENT DOCUMENTS

| | | | |
|---|---|---|---|
| 415,773 | A | 11/1889 | Fiske |
| 799,754 | A | 9/1905 | Petrie |
| 803,014 | A | 10/1905 | McIlravy |
| 813,901 | A | 2/1906 | Leming et al. |
| 819,055 | A | 5/1906 | Fisher |
| 824,235 | A | 6/1906 | Damon |
| 838,278 | A | 12/1906 | Schwartz |
| 978,600 | A | 12/1910 | Lampman |
| 1,166,312 | A | 12/1915 | Barten |
| 1,564,490 | A | 12/1925 | Parkhurst |
| 1,596,165 | A | 8/1926 | Evans |
| 1,678,613 | A | 7/1928 | Weiss |
| 1,693,852 | A | 12/1928 | McQuain |
| 1,776,999 | A | 9/1930 | Jensen |
| 1,982,730 | A | 12/1934 | Erkman |
| 2,038,205 | A | 4/1936 | Case |
| 2,298,446 | A | 10/1942 | White |
| 2,313,363 | A | 3/1943 | Schmitt |
| 2,457,368 | A | 12/1948 | Hanson |
| 2,517,432 | A | 8/1950 | Hornberger |
| 2,544,488 | A | 3/1951 | Chittenden |
| 2,682,093 | A | 6/1954 | Clanton |

(Continued)

FOREIGN PATENT DOCUMENTS

| | | | |
|---|---|---|---|
| DE | 196 34 499 | A1 | 3/1998 |

(Continued)

*Primary Examiner*—Richard Crispino
*Assistant Examiner*—Thu Khanh T Nguyen
(74) *Attorney, Agent, or Firm*—Ulbrich I.P., Ltd.

(57) ABSTRACT

A system and method for manufacturing an uncured concrete block using the dry-cast manufacturing process includes a mold box having a pair of side walls, a pair of side plates, an open top side and an open bottom side defining a mold cavity. One or more end liners are disposed within the mold cavity and are selectively shiftable within the mold cavity with hydraulic cylinders between a first position and a second position. The end liners can be provided with a three-dimensional textured face to impart a decorative face to a side surface of the concrete block formed in the mold or can also provide blocks with a tapered face when disposed in the second position while the mold is filled with concrete. Before the block is stripped from the mold, the end liners are returned to the first position, so that the side surfaces are not damaged as the block is released.

14 Claims, 10 Drawing Sheets

U.S. PATENT DOCUMENTS

| | | | |
|---|---|---|---|
| 2,700,810 | A | 2/1955 | Garni |
| 2,819,495 | A | 1/1958 | Krausz |
| 2,882,689 | A | 4/1959 | Huch et al. |
| 3,013,321 | A | 12/1961 | McElroy |
| 3,204,316 | A | 9/1965 | Jackson |
| 3,277,551 | A | 10/1966 | Sekiguchi |
| 3,425,105 | A | 2/1969 | Gulde |
| 3,426,122 | A | 2/1969 | Gaudelli et al. |
| 3,442,991 | A | 5/1969 | Lanz |
| 3,530,553 | A | 9/1970 | Engle et al. |
| 3,659,986 | A | 5/1972 | Gelbman |
| 3,669,402 | A | 6/1972 | Paulson |
| 3,694,128 | A | 9/1972 | Foxen |
| 3,731,899 | A | 5/1973 | Nuzzo |
| 3,918,877 | A | 11/1975 | Pickett |
| 3,940,229 | A | 2/1976 | Hutton |
| 3,981,953 | A | 9/1976 | Haines |
| 4,005,972 | A | 2/1977 | Sommers |
| 4,050,864 | A | 9/1977 | Komaki |
| 4,063,866 | A | 12/1977 | Lurbiecki |
| 4,178,340 | A | 12/1979 | Hyytinen |
| 4,272,230 | A | 6/1981 | Abate |
| 4,563,144 | A | 1/1986 | Rose |
| 4,784,821 | A | 11/1988 | Leopold |
| 4,802,320 | A | 2/1989 | Forsberg |
| 4,802,836 | A | 2/1989 | Whissell |
| 4,869,660 | A | 9/1989 | Ruckstuhl |
| 4,902,211 | A | 2/1990 | Svanholm |
| 4,909,010 | A | 3/1990 | Gravier |
| 4,909,717 | A | 3/1990 | Pardo |
| D317,209 | S | 5/1991 | Forsberg |
| 5,056,998 | A | 10/1991 | Goossens |
| 5,078,940 | A | 1/1992 | Sayles |
| 5,135,384 | A | 8/1992 | Redwine |
| 5,183,616 | A | 2/1993 | Hedrick |
| 5,217,630 | A | 6/1993 | Sayles |
| 5,249,950 | A | 10/1993 | Woolford |
| 5,366,676 | A | 11/1994 | Kobayashi |
| 5,435,949 | A | 7/1995 | Hwang |
| 5,484,236 | A | 1/1996 | Gravier |
| 5,490,363 | A | 2/1996 | Woolford |
| 5,534,214 | A | 7/1996 | Sakamoto et al. |
| 5,589,124 | A | 12/1996 | Woolford et al. |
| 5,598,679 | A | 2/1997 | Orton et al. |
| D380,560 | S | 7/1997 | Forsberg |
| 5,651,912 | A | 7/1997 | Mitsumoto et al. |
| 5,711,129 | A | 1/1998 | Woolford |
| 5,744,081 | A | 4/1998 | Tanigawa et al. |
| 5,756,131 | A | 5/1998 | Suh |
| 5,791,827 | A | 8/1998 | Arvai et al. |
| 5,795,105 | A | 8/1998 | Guth |
| 5,816,749 | A | 10/1998 | Bailey, II |
| 5,827,015 | A | 10/1998 | Woolford et al. |
| 5,939,104 | A | 8/1999 | Johnston |
| 6,029,943 | A | 2/2000 | Sievert |
| 6,093,012 | A | 7/2000 | Hess et al. |
| D429,006 | S | 8/2000 | Price et al. |
| 6,113,318 | A | 9/2000 | Guth |
| 6,178,704 | B1 | 1/2001 | Sievert |
| 6,224,250 | B1 | 5/2001 | Kreinhelder et al. |
| 6,224,815 | B1 | 5/2001 | LaCroix et al. |
| 6,312,197 | B1 | 11/2001 | Woolford et al. |
| 6,321,740 | B1 | 11/2001 | Scherer et al. |
| 6,322,742 | B1 | 11/2001 | Bott et al. |
| 6,347,931 | B1 * | 2/2002 | Underwood ..... 425/62 |
| 6,382,947 | B1 | 5/2002 | Bryant |
| 6,464,199 | B1 | 10/2002 | Johnson |
| 6,499,985 | B1 | 12/2002 | Sekiguchi et al. |
| 6,557,818 | B2 | 5/2003 | Manthei |
| 6,773,642 | B1 | 8/2004 | Wardell |
| 6,814,906 | B2 | 11/2004 | Bergeron et al. |
| 6,835,343 | B2 | 12/2004 | Manthei et al. |
| 7,021,919 | B2 | 4/2006 | Griffith |
| 7,100,886 | B2 | 9/2006 | Hammer et al. |
| 7,140,867 | B2 | 11/2006 | Scherer et al. |
| 7,156,645 | B2 | 1/2007 | Ness |
| 7,175,414 | B2 | 2/2007 | Ness et al. |
| 7,208,112 | B2 | 4/2007 | Scherer |
| 7,261,548 | B2 | 8/2007 | Ness |
| D551,358 | S | 9/2007 | Deragon |
| 7,328,537 | B2 | 2/2008 | Hammer et al. |
| 2003/0067096 | A1 | 4/2003 | Jurik |
| 2003/0126821 | A1 | 7/2003 | Scherer et al. |
| 2003/0182011 | A1 | 9/2003 | Scherer |
| 2004/0218985 | A1 | 11/2004 | Klettenberg et al. |
| 2006/0179777 | A1 | 8/2006 | Tufts et al. |
| 2007/0193181 | A1 | 8/2007 | Klettenberg |

FOREIGN PATENT DOCUMENTS

| | | | |
|---|---|---|---|
| DE | 100 02 390 | A1 | 7/2001 |
| FR | 2622227 | A1 | 10/1987 |
| GB | 2 232 114 | A | 12/1990 |

* cited by examiner

SYSTEM AND METHOD FOR MANUFACTURING CONCRETE BLOCKS

FIELD OF THE INVENTION

The present invention relates generally to the manufacture of concrete wall blocks. More specifically, the present invention relates to the manufacture of concrete wall blocks using the dry-cast method wherein the blocks have two or more adjacent decorative faces.

BACKGROUND OF THE INVENTION

Concrete blocks are used to form free standing and retaining walls. In such applications, the visible face or faces of the blocks are often provided with a textured or decorative appearance. Concrete blocks for forming walls are used in a variety of applications from small gardening applications to large-scale construction projects. Blocks are stacked in horizontal rows called courses. Multiple successive courses may be used to create a vertically rising wall of a desired height.

The concrete blocks used in constructing such walls are often manufactured using the dry cast process, which uses dry-cast block machinery to form blocks at a relatively high rate of speed. In a typical dry-cast block machine, material is fed into an open top mold from the top side. The conventional mold consists of stationary sides, to define the sidewalls of the block, and an open bottom. A removable pallet is used to temporarily close the open bottom of the mold and serve as a base during the block forming operation.

During manufacture, the material introduced through the open top collects on top of the pallet and is bounded by the end and side panels. A compression head is then pressed downwards under high pressure onto the material through the open top of the mold to compact the material therein. The head forces material into the mold so as to conform to the shape of the mold. The mold may also be vibrated during compaction to promote uniform compaction. The head may also be provided with one or more shoes that have relief defined therein in order to impart detail into the material that is contacted by the head's movement.

After compaction and vibration, the bottom pallet drops down, the head follows the pallet and the newly made product downward while the sides of the mold remain in position, and when the product clears the bottom of the mold, the pallet moves away from the mold and another pallet moves in place to make the next product. The head returns to its original position and the feed drawer brings more material into the mold to make the next product. The molding machinery is able to cycle several times per minute.

U.S. Pat. No. 5,827,015 teaches the use of conventional dry cast molding methods to form a twinned concrete slug in the molding machinery. The slug is then split into two blocks after being cured. It should be appreciated that the top surface of the finished wall block made according to the conventional dry cast manufacturing method is formed by the surface of the steel pallet. The bottom of the block is accordingly formed by the stripper shoe.

The need to eject the formed blocks through the bottom of the mold used in dry cast manufacture places limitations on the ability to create a decorative front face on the block because the sidewalls of the mold shear across the side surfaces of the block when stripped from the mold. Therefore, efforts have been made to provide for a decorative front face on concrete wall blocks.

One common current method of producing a wall block with a decorative front surface is to split a cured block (or a twinned slug) so that the front surface of the block has a fractured concrete surface that looks somewhat like split rock. This is done by forming a slug in a mold and providing one or more grooves in the slug to function as one or more splitting planes. The slug is then split apart to form two or more blocks. The appearance of the face of such block is exhibited by U.S. Pat. No. D380,560. This gives the front face of structures built with these blocks some visual depth that makes the structure look more natural. The number of facets and their arrangement can be varied to provide for different looks such as shown in U.S. Pat. No. D429,006.

More recent references, such as U.S. Pat. No. 6,321,740, disclose modification of the splitter blade used in splitting the cured block to provide edges that appear more weathered. Splitting, however, adds additional production costs by requiring an additional step to the manufacturing process and results in waste material. Furthermore, split-faced concrete blocks do not sufficiently resemble natural stone to satisfy some consumer needs.

Another method to make blocks that have decorative front surfaces is described in U.S. Pat. Nos. 5,078,940; 5,217,630; and 6,224,815. These patents describe a method and an apparatus for manufacturing a concrete block having an irregular surface. The irregular surface can be made to look similar to split stone. This method includes pouring uncured block material into a mold cavity and causing a portion of the material to be retained in place relative to the cavity walls when the block is removed from the cavity. The result is a somewhat split appearance for the surface, without having to perform the splitting operation. However, the block produced from this method still does not satisfactorily resemble natural stone.

Other methods employed to provide for improved decorative appearance include spraying the front face of an uncured block to wash away some cement to leave exposed aggregate. Another method consists of "weathering" a cured block by tumbling it in a tumbler with tumbler chips that knock off random pieces of the block, which rounds the ends and creates a look closer to the appearance of weathered stone. These methods, however, are labor intensive and can damage the blocks, resulting in a higher overall cost of production.

Commonly owned, copending application Pub. No. US 2004/0218985, which is hereby incorporated by reference in its entirety, discloses an alternative method of providing a decorative simulated natural stone face to the front surface of a block while using the dry cast manufacturing method. The molding apparatus is configured such that the front surface of the block faces up in the mold and can therefore be provided with a pre-defined decorative face because the shoe stamps or contacts it directly. This process, however, limits the ability to provide for sidewalls that deviate from conformance to the smooth vertical sidewalls of the mold box because the downward movement of the block through the mold prevents a mold with stationary angled sidewalls or relief from being used.

U.S. Patent Pub. Nos. 2003/0126821 and 2003/0182011 disclose a block machine that stamps a face on the front surface of a block while also providing a tapered sidewall to the block by use of pivoting sidewalls. However, this system does not teach the ability to impart a complex decorative face on the side surfaces of the blocks. In addition, the mold must be taken apart to a degree that makes it difficult to perform maintenance or repairs of the biasing mechanisms. This difficulty can cause undesirable delays in production.

A block and a method of making a block having two or more adjacent decorative faces is disclosed in commonly owned, copending U.S. Patent Publication No. 2007/

0193181. The method involves utilizing a core puller mechanism to move end liners to a first, or fill, position to impart one or more decorative side faces as the block is formed. Before the block is stripped from the mold, the core puller mechanism pulls the end liners back to a second, or strip, position so that the decorative side faces are not damaged as the block is released. A drawback, however, is that the core puller mechanism is a large and complex piece of machinery that requires a large amount of space on the production floor and can take a significant amount of time to setup and install. Additionally, the moving parts in the mold may sometimes lack sufficient stability during various stages of molding, thereby causing undesired cracking of the block.

What is still needed in the industry is a system and method of making a block having two or more adjacent decorative faces that may more closely resemble natural stone or other decorative masonry element.

SUMMARY OF THE INVENTION

The present invention addresses the need in the industry for a system and method of making a block having two or more adjacent decorative faces that may resemble natural stone or other decorative masonry element. In an embodiment, a system and method for manufacturing an uncured concrete block using the dry-cast manufacturing process includes a mold box having a pair of side walls, a pair of side plates, an open top side and an open bottom side defining a mold cavity. Division plates can span the mold cavity to define multiple mold cavities. One or more end liners are disposed within the mold cavity. Hydraulic cylinders located within the mold cavity are configured to move the end liners between a first position and a second position. The hydraulic cylinders may be connected to a tubing system and an electronically controlled pumping unit. The hydraulic cylinders move the end liners move from the first position to the second position before a concrete mixture is introduced into the mold. End liners can be provided with a three-dimensional textured face to provide a decorative face to a side surface of the concrete block formed in the mold. End liners can also provide blocks with a tapered face. Before the block is stripped from the mold, the end liners are returned to the first position, so that the side surfaces are not damaged as the block is released.

DETAILED DESCRIPTION

Figure 1:
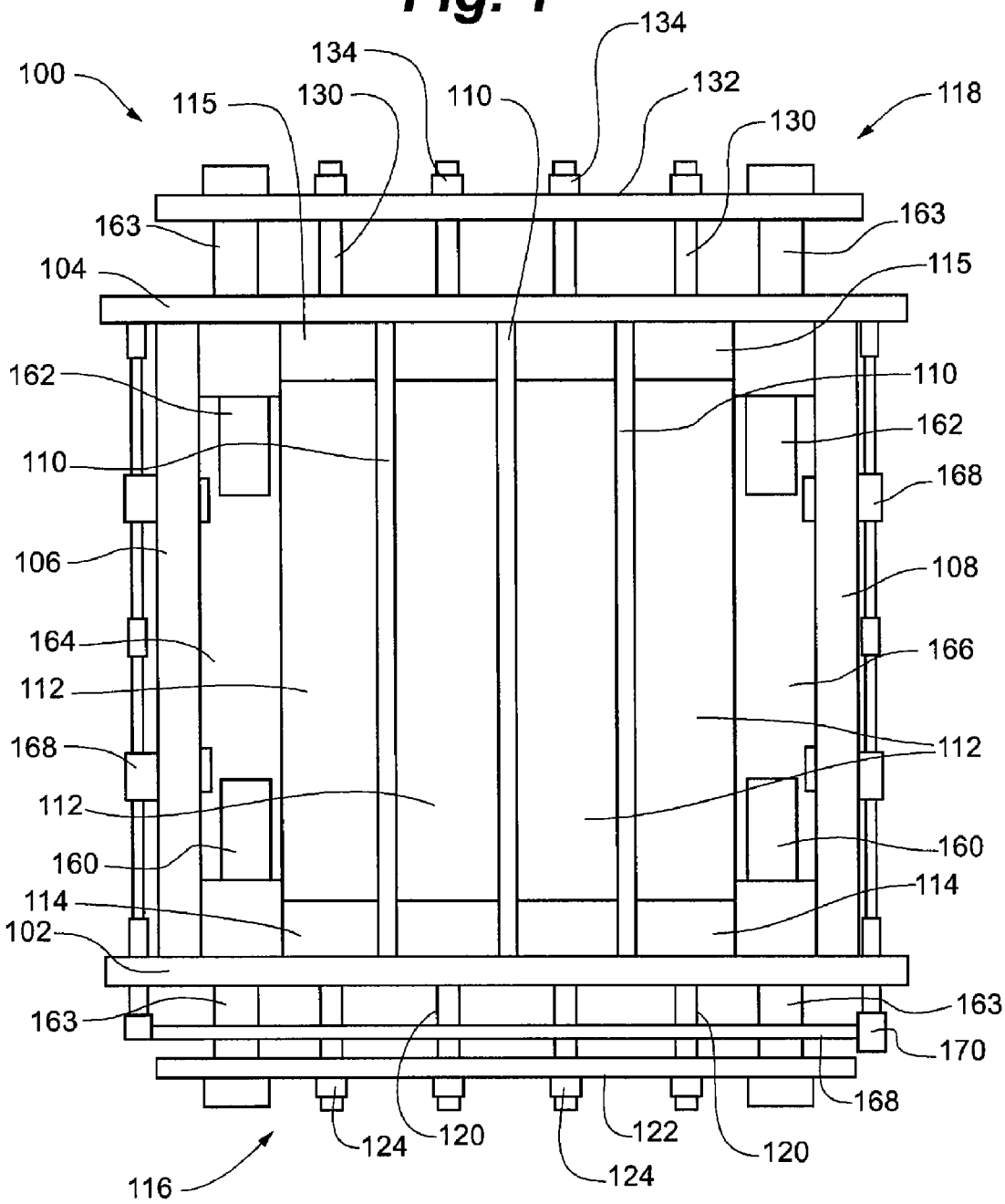
FIG. 1 is a top view of a mold apparatus according to an embodiment of the present invention in a first position.
Figure 2:
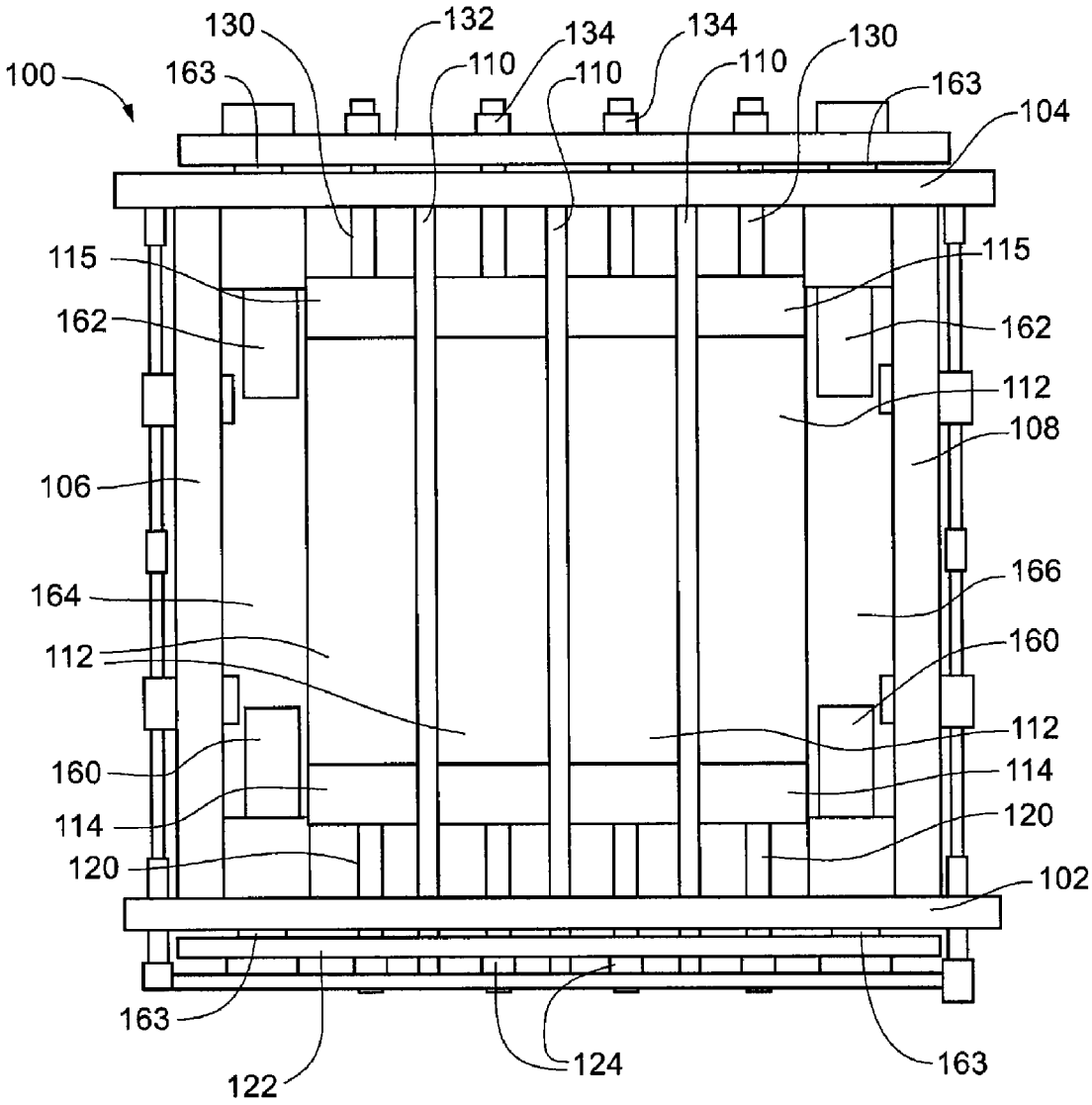
FIG. 2 is a top view of a mold apparatus according to an embodiment of the present invention in a second position.

Referring to FIGS. 1-2, there is depicted a dry-cast block mold 100 according to an embodiment of the present invention. FIG. 1 depicts block mold 100 in a first position corresponding to a "release" or "strip" position. FIG. 2 depicts block mold 100 in a second position corresponding to a "fill" position.

Dry-cast block mold 100 generally includes of a pair of side bars 102, 104, and a pair of side plates 106, 108 that define an open interior region. Division plates 110 span side bars 102, 104, creating multiple mold cavities 112. A front end liner 114 and a rear end liner 115 can be disposed in each mold cavity 112. One of skill in the art will recognize that the number of division plates may be varied to increase or decrease the number of mold cavities, and accordingly, the respective number of end liners.

Front end liners 114 are connected and controlled by a front end liner connector assembly 116. Front end liners 114 are each connected to a front end liner push member 120. Front end liner push members 120 are coupled to one another by a front end liner push bar 122, to which each front end liner push member 120 is connected with a fastener 124. Rear end liners 115 are actuated by a rear end liner connector assembly 118. Rear end liners 115 are connected to rear end liner push members 130 which are linked to one another by a rear end liner push bar 132 to which they are attached with fasteners 134. It will be appreciated that in some embodiments, the position of each of end liner 114, 115 may be individually adjusted relative to push bars 122, 132, respectively by adjusting the length of push members 120, 130. Each push member 120, 130, may for example include two or more separate pieces connected with a threaded coupling or may be solid and connected to the push bar or the end liner with standoffs, shims, or washers of varying dimension to enable length adjustment of the push member 120, 130.

Figure 3:
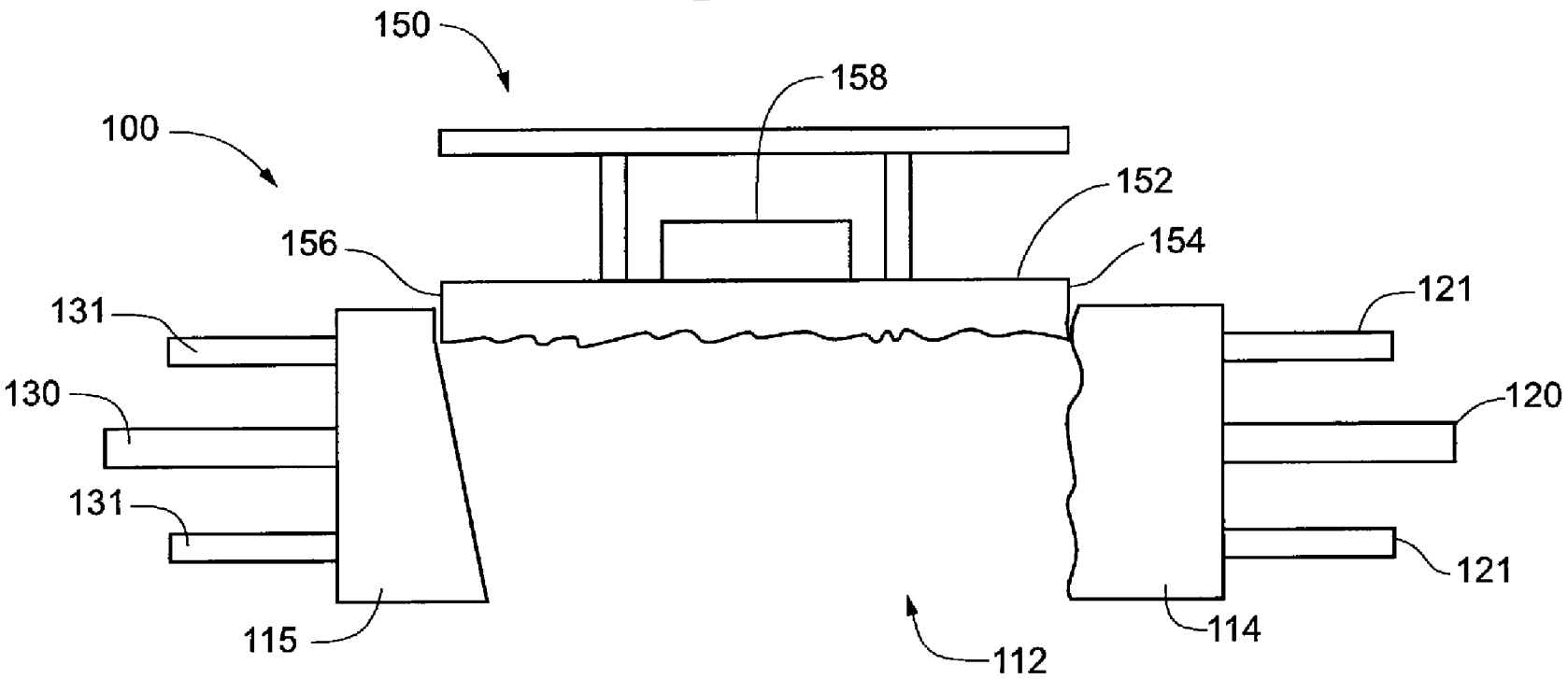
FIG. 3 is a side view of a pair of end liners and a compression head assembly according to an embodiment of the present invention.
Figure 5:
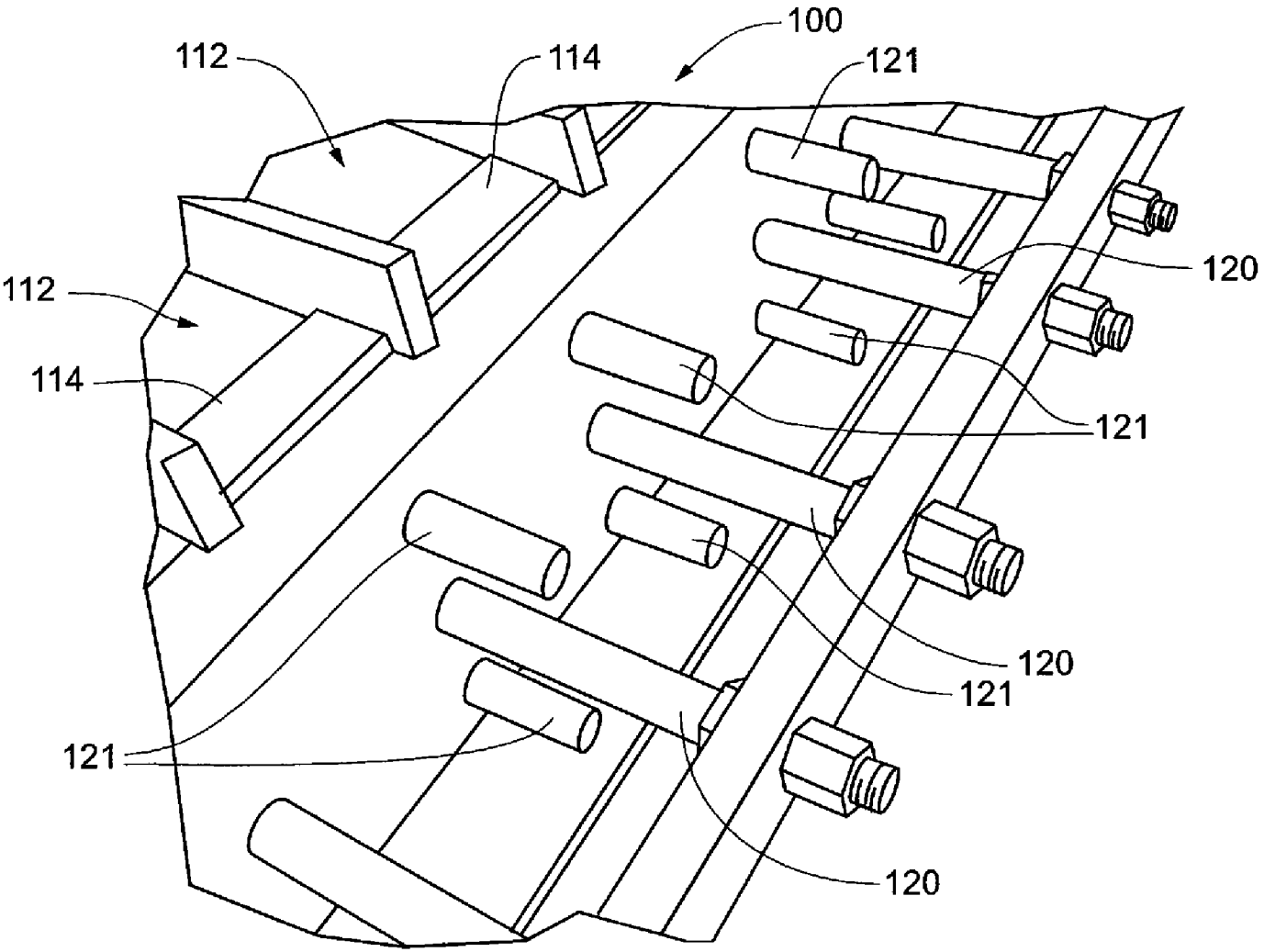
FIG. 5 is a partial perspective view of a mold apparatus according to an embodiment of the present invention.

Referring to FIGS. 3 and 5, each front end liner 114 is also attached to a pair of guide members 121 that are aligned parallel to end liner push members 120. Similarly, each rear end liner 115 is attached to a pair of guide members 131. Guide members 121, 131 function to maintain the alignment of end liners 114, 115 and to resist forces applied to end liners 114, 115 throughout the molding process. These guide members 121, 131, along with the relative rigidity of connection of end liners 114, 115, with push bars 122, 132, imparts positional stability to end liners 114, 115, thereby inhibiting undesired shifting of end liners 114, 115, and vibration during the molding process which may lead to later cracking of the finished block.

Actuating devices in the form of a pair of front hydraulic cylinders 160 and a pair of rear hydraulic cylinders 162 are disposed in cavities 164, 166, located laterally from the mold cavities 112. Hydraulic cylinders 160, 162 are used to move front end liners 114 and rear end liners 115 between the "fill" and "strip" positions with connecting members 163 attached to front and rear end liner push members 120, 130. A tubing system 168 is connected to hydraulic cylinders 160, 162 and runs along the length of side bar 102 and down side plates 106, 108 to deliver fluid to power the hydraulic cylinders 160, 162. Tubing system 168 includes a connector 170 for connecting tubing system 168 to a pumping unit. Pumping unit can be connected to an electrical control unit to control fluid flow. Pumping unit can also communicate with proximity switches on mold box 100 which can allow or restrict movement of a head assembly depending on the position of the mold. It will be appreciated that in alternative embodiments, the configuration, location, and positioning of tubing system 168 and hydraulic cylinders 160, 162 may be altered while remaining within the scope of the present invention. Moreover, other actuating devices and systems such as mechanical linkages or screws driven by a power source may be substituted for hydraulic cylinders 160, 162, while remaining within the scope of the present invention.

Mold box 100 will generally rest in the strip position depicted in FIG. 1 when the machine is idle. The machine is moved into the fill position depicted in FIG. 2 so that it can be filled with a dry-cast concrete mixture. This is done by actuating front hydraulic cylinders 160 that move front end liners 114 forward towards the middle of cavities 112. Rear hydraulic cylinders 162 move rear end liners 115 forward towards the middle of cavities 112. The mold cavities 112 are then filled with mold material and the hydraulic cylinders 160, 162, hold the end liners 114, 115 in place while the mold is filled, vibrated and compacted. When the mold material is stripped from the mold, front end liners 114 and rear end liners 115 are pulled back to the strip position by their respective hydraulic cylinders 160, 162.

Figure 4:
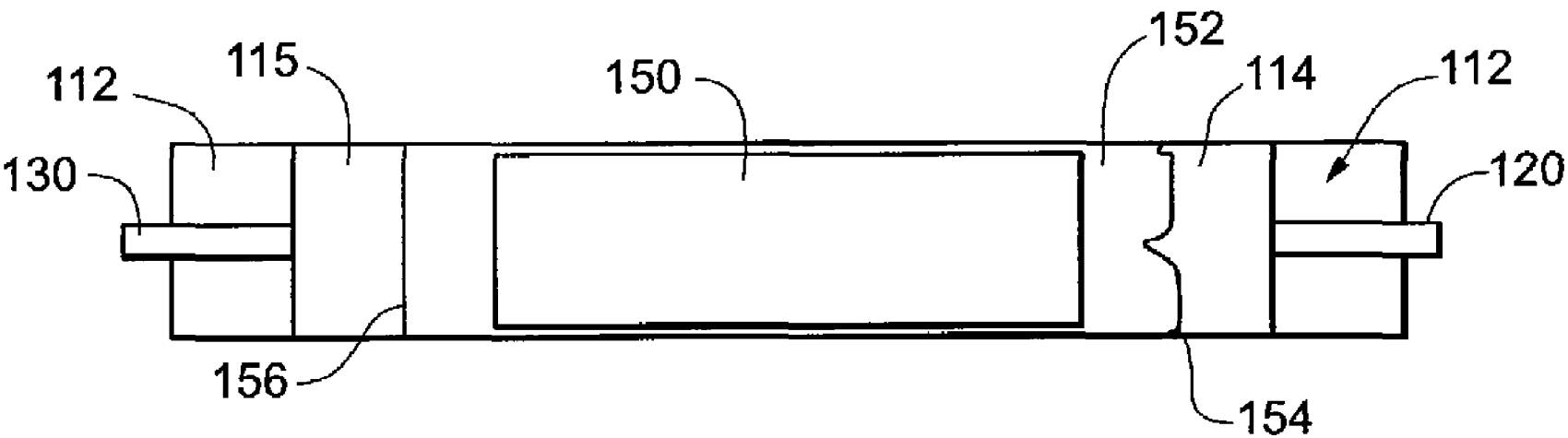
FIG. 4 is a top view of a pair of end liners and a compression head assembly according to an embodiment of the present invention.

Referring to FIGS. 3 and 4, the outside edges of the head shoe 154, 156 of the head assembly 150 are given cooperating relief with the top portion of the faces of each pair of end liners 114, 115. This configuration allows both the head shoe 152 and the end liners 114, 115, to fully contact the mold material, and thus impart a higher quality face, when the end liners 114, 115 are in the fill position and the head shoe 152 is being used to compress the material. It will be appreciated that the use of both a head shoe and end liners to provide a face to the block allows a block to be produced that has a decorative appearance on as many as three consecutive sides.

End liners 114, 115 may be used to either impart a decorative pattern or to provide a taper to the block sides as may be desired. Although depicted in FIGS. 3 and 4 as having tapered end liners 115 on one side and faced end liners 114 on the other, mold box may have identical end liners on both of its ends. In one configuration, a smooth non-tapered end liner is used on one side while the opposing end liner includes three dimensional relief to imprint three dimensional texture on the opposite side face. In some embodiments where one or more textured end liners are used in conjunction with a textured head shoe to make a block with two or more adjacent textured faces, the length of the push member attached to each textured end liner may be adjusted during set up of the apparatus so as to optimize its positional relationship with the head shoe when in the fill position. Undesirable interference between the textured end liner and the head, or an excessive gap which may cause a discontinuity at the corner of the finished block, may be thereby alleviated or avoided. Further, it will be appreciated that a portion of the side of the head shoe 152 may be provided with complimentary relief to conform to the relief in end liner 114. Otherwise, a tight tolerance between the head shoe 152 and end liner 114 may be difficult to achieve and material may undesirably flow into the gap formed therebetween during the forming process.

End liners 114, 115 can provide decorative appearances with greater detail and relief than can be provided using conventional techniques, such as splitting and tumbling. Such decorative appearances include broken rock, stacked rocks, natural stone, brick, striated or roughened texture. Persons of skill in the art of concrete block manufacturing using the dry-cast process will recognize that various decorative appearances can be imparted on the front surfaces of the blocks, and that the present invention is not limited to a specific decorative facial appearance unless specifically indicated in a given claim.

To prevent concrete material from accumulating on faced end liners 114 and degrading the quality of the decorative appearance imparted to the block surface, end liners 114 may be heated. Heat is provided to end liners 114 by operatively connecting at least one heat element (not shown) to end liners 114. Suitable heat elements include resistance elements that may be hard wired, solid state, or semiconductor circuitry. Head shoe 152 may also provided with a heat source 158, as is known in the art. The division plates and mold cavities may also be heated.

The use of hydraulic cylinders 160, 162 located within the mold box 100 to move the end liners 114, 115 in order to form concrete blocks having two or more adjacent decorative faces reduces set-up, installation, and maintenance time versus use of a core puller or other specialized system because it utilizes standard mold installation and set-up. Use of hydraulic cylinders 160, 162 within the mold box 100 also requires minimal additional space on the production floor. A more consistent, higher quality finished product is also produced with the use of hydraulic power rather than pneumatic power.

Figure 6B:
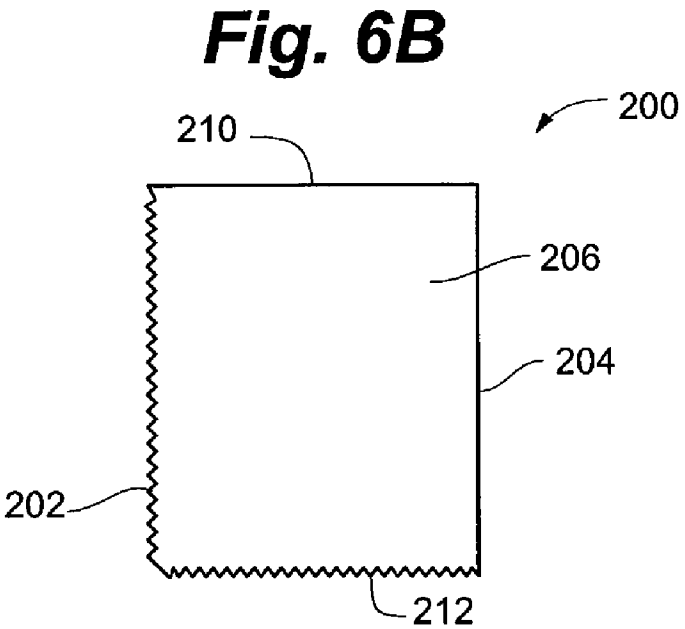
FIG. 6A is a perspective view and FIG. 6B is a top view of a concrete block according to an embodiment of the present invention.
Figure 6A:
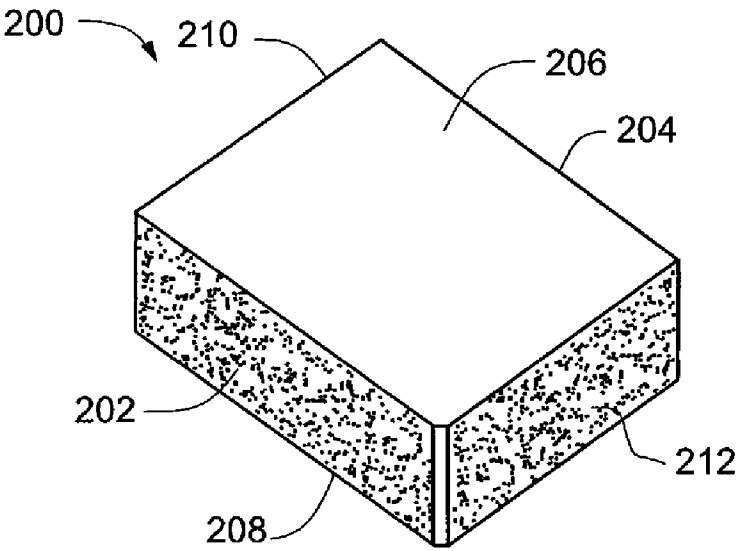
Figure 7B:
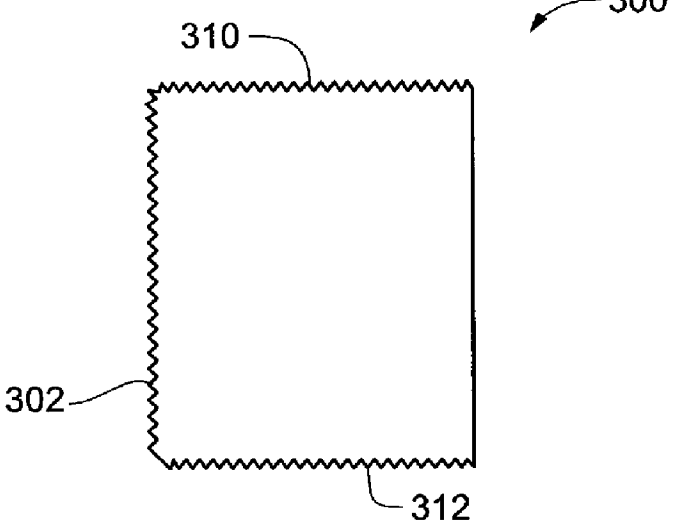
FIG. 7A is a perspective view and FIG. 7B is a top view of a concrete block according to an embodiment of the present invention.
Figure 7A:
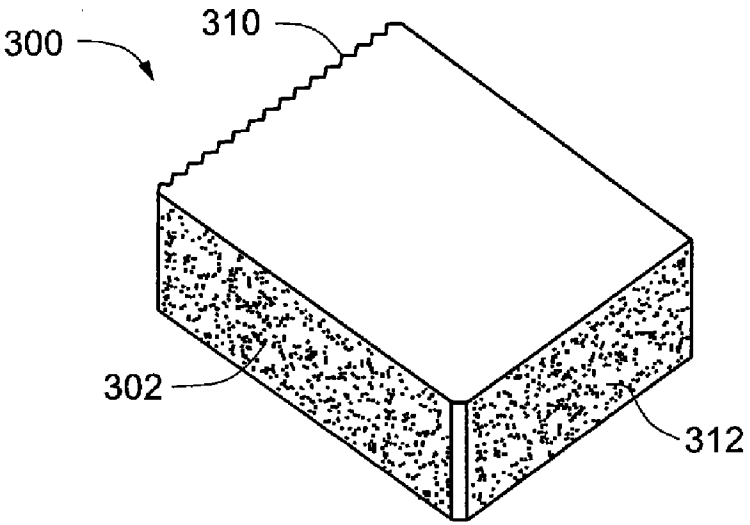
Figure 8B:
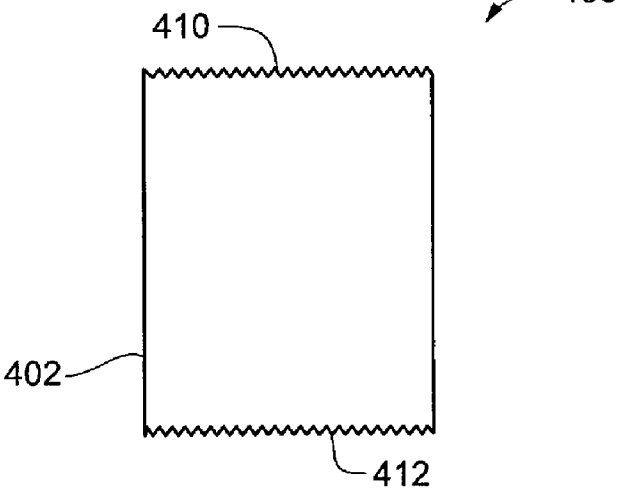
FIG. 8A is a perspective view and FIG. 8B is a top view of a concrete block according to an embodiment of the present invention.
Figure 8A:
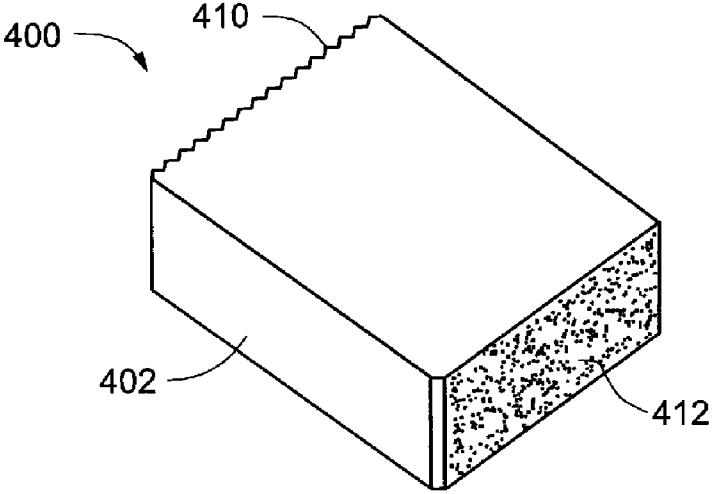

Referring to FIGS. 6A-6B, there is depicted an embodiment of a concrete block 200 that can be made using the dry cast block mold 100 according to an embodiment of the present invention. Block 200 includes a front surface 202 and opposing rear surface 204, a top surface 206 and opposing bottom surface 208, and opposing first 210 and second 212 side surfaces. Front surface 202 has a decorative appearance imparted by the head shoe because front surface 202 faces up in the mold. Side surface 212 has a decorative design imparted by either a front or rear end liner having decorative relief defined therein. End liner 114 of FIG. 3 can be used to make the decorative side surface 212 shown in FIGS. 6A and 6B. The opposing end liner is smooth to provide for a smooth side surface 210. Alternatively, as shown in FIGS. 7A and 7B, block 300 may be provided with decorative faces on front surface 302 and both first 310 and second 312 side surfaces. This is done by providing the mold with both front and rear end liners having decorative relief. A further alternative, shown in FIGS. 8A and 8B, is to provide a block 400 with decorative side surfaces 410 and 412 and a smooth front surface 402. In such an application, textured front and rear end liners are used while the head shoe is smooth to create a smooth front surface. The pattern given to decorative faces can vary depending on the desired appearance for a particular wall or wall section, as explained previously. Decorative faces in a particular block may have the same or different appearance.

Figure 9B:
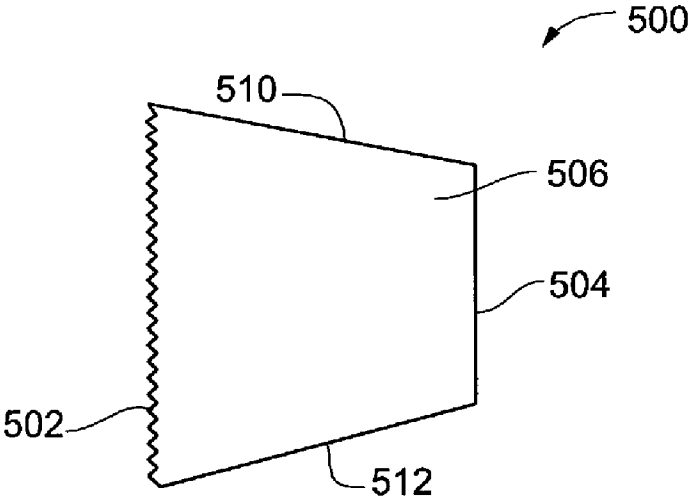
FIG. 9A is a perspective view and FIG. 9B is a top view of a concrete block according to an embodiment of the present invention.
Figure 9A:
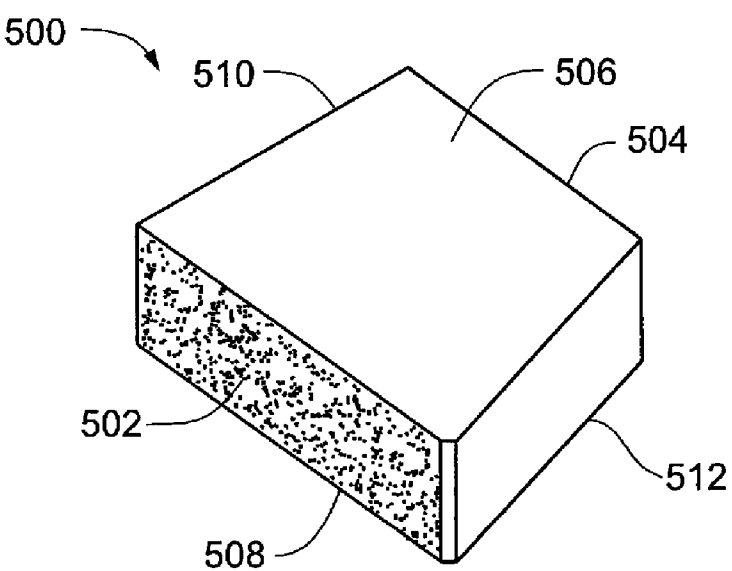

FIGS. 9A-9B depict another embodiment of a concrete block 500 that can be made using the dry cast block mold 100 according to an embodiment of the present invention. Block 500 includes a front surface 502 and opposing rear surface 504, a top surface 506 and opposing bottom surface 508 and opposing first 510 and second 512 side surfaces. Front surface 502 has a decorative appearance imparted by the head shoe. Side surfaces 510, 512 are both tapered. Blocks with one or more tapered side surfaces are particularly adapted to create serpentine or otherwise curved walls. End liners similar to the end liner 115 depicted in FIGS. 3 and 4 are used to make such a block 500.

Figure 10B:
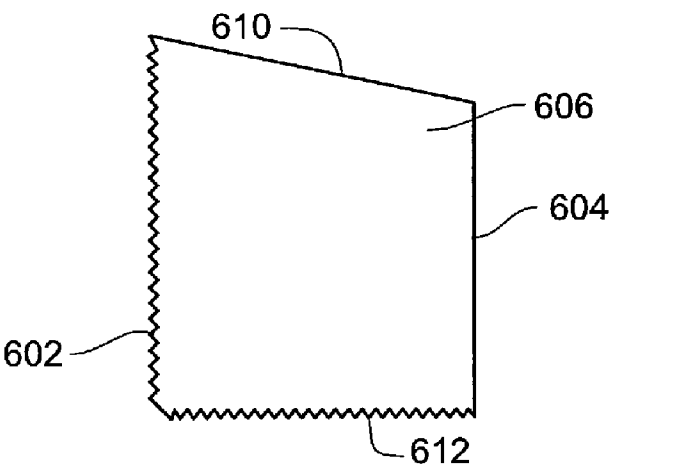
FIG. 10A is a perspective view and FIG. 10B is a top view of a concrete block according to an embodiment of the present invention.
Figure 10A:
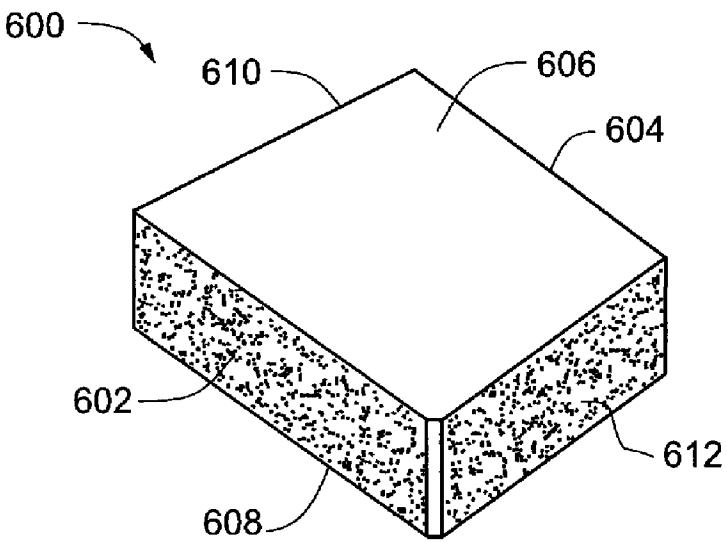

FIGS. 10A-10B depict a concrete block 600 that includes a decorative front surface 602 with an opposing rear surface 604, a top surface 606 and opposing bottom surface 608, and first 610 and second 612 opposing side surfaces. This block 600 is formed, however, using one textured face end liner and one smooth tapered end liner, such that side surface 612 is tapered and side surface 610 has a decorative appearance.

Blocks made according to the present invention may also be provided with an interlocking extension to facilitate stacking of blocks and create a setback between courses of blocks. A mold for creating such a block is disclosed in commonly-owned copending application Pub. No. 2004/0218985, fully incorporated by reference above. To modify the mold of the present invention to produce blocks with protrusions in addition to multiple faces or tapers, a notch in the shape of the desired protrusion is added to the division plates as disclosed in the above publication.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the appended claims.

What is claimed:

1. A system for manufacturing an uncured concrete block using a dry-cast manufacturing process, comprising:
- a mold box including a pair of side walls, a pair of side plates fixedly fastened to the pair of sidewalls so that the sidewalls and side plates do not substantially move, an open top side and an open bottom side, defining an open interior region;
- a division plate spanning the open interior region to define a plurality of separate mold cavities within the open interior region;
- a movable end liner disposed within two or more of the plurality of separate mold cavities;
- a hydraulic cylinder located within the open interior region and operably coupled with the movable end liners to selectively shift the movable end liners between a first position and a second position; and
- a push member connected to the movable end liners;
- a push bar connected to the push member; and
- a connecting member extending from the hydraulic cylinder connected to the push bar.

2. The system of claim 1, further comprising a tubing system connected to the hydraulic cylinder.

3. The system of claim 2, further comprising a pumping unit connected to the tubing system.

4. The system of claim 3, wherein the pumping unit is electronically controlled.

5. The system of claim 1, wherein the movable end liner is provided with a face having a three-dimensional texture.

6. The system of claim 1, wherein the movable end liner is provided with a tapered face.

7. The system of claim 1, further comprising a second end liner, opposing the first end liner, disposed within two or more of the plurality of separate mold cavities.

8. A system for manufacturing an uncured concrete block using the dry-cast manufacturing process, comprising:
- a mold box having a generally vertically extending internal perimeter surface that maintains a generally vertical orientation during the manufacturing process, the mold box comprising:
  - a pair of side walls,
  - a pair of side plates fastened to the pair of sidewalls so that the side plates do not move with respect the side walls during the manufacturing process,
  - an open top side and
  - an open bottom side,
  - wherein the pair of sidewalls, the pair of side plates, the open top and the open bottom define an open interior region having a fixed volume that is maintained throughout the manufacturing process, and;
- a division plate spanning the open interior region to define a plurality of separate mold cavities within the open interior region;
- a movable end liner disposed within two or more of the plurality of separate mold cavities;
- at least one actuator device disposed in the open interior region;
- a push member connected to the movable end liners;
- a push bar connected to the push member; and
- a connecting member extending from the at least one actuator connected to the push bar.

9. The system of claim 8, wherein the at least one actuator device includes a hydraulic cylinder.

10. The system of claim 8, further comprising a second movable end liner disposed, opposing the first end liner, disposed within two or more of the plurality of separate mold cavities.

11. The system of claim 10, further comprising a second actuator device operably coupled with the second movable end liner to selectively shift the second end liner.

12. The system of claim 11, wherein the first and second movable end liners are each provided with a face having a three-dimensional decorative texture whereby the faces impart a mirror image of the three-dimensional decorative texture to opposing sides of the uncured concrete block.

13. The system of claim 8, further comprising a compression head including a shoe, the shoe presenting a face having a three-dimensional decorative texture whereby the face imparts a mirror image of the three-dimensional decorative texture to a surface of the uncured concrete block.

14. A system for manufacturing an uncured concrete block using the dry-cast manufacturing process, comprising:
- a mold box including a pair of generally vertically oriented side walls, a pair of generally vertically oriented side plates, an open top side and an open bottom side defining an open interior region, the pair of side walls and pair of side plates fastened to each other so that during a manufacturing cycle they maintain their respective generally vertical orientations and the open interior region does not change in size or shape;
- a division plate spanning the open interior region to define a plurality of separate mold cavities within the open interior region;
- at least one movable end liner operably disposed within the two or more of the plurality of separate mold cavities;
- means for selectively shifting the end liners between a first position and a second position disposed in the open interior region;
- a push member connected to the movable end liners;
- a push bar connected to the push member; and
- a connecting member extending from the push bar to the means for selectively shifting the end liners.

* * * * *